US005762004A

United States Patent [19]

Vashon et al.

[11] Patent Number: 5,762,004

[45] Date of Patent: Jun. 9, 1998

[54] PORTABLE, COLLAPSIBLE, BEACH AND LAWN RECREATION TABLE

[76] Inventors: Adrian R. Vashon; Lisa G. Vashon, both of 3168 E Danish Way, Salt Lake City, Utah 84121

[21] Appl. No.: 727,742

[22] Filed: Oct. 8, 1996

[51] Int. Cl.[6] ..... A47B 13/02

[52] U.S. Cl. ..... 108/150; 108/128

[58] Field of Search ..... 108/150, 125, 108/128, 115; 248/85, 87, 88, 434, 435

[56] References Cited

U.S. PATENT DOCUMENTS

| | | | |
|---|---|---|---|
| 523,072 | 7/1894 | Joy | 108/128 X |
| 2,137,799 | 11/1938 | Brandenburg | 108/128 X |
| 3,495,554 | 2/1970 | Wagner | 108/128 |
| 3,960,092 | 6/1976 | Levkovski | 248/434 X |
| 5,188,422 | 2/1993 | Montgomery | 108/150 X |

FOREIGN PATENT DOCUMENTS

| | | | |
|---|---|---|---|
| 648090 | 12/1928 | France | 108/150 |
| 850535 | 12/1939 | France | 108/150 |
| 266852 | 6/1925 | Germany | 108/150 |
| 439313 | 11/1925 | Germany | 248/435 |

*Primary Examiner*—Jose V. Chen

*Attorney, Agent, or Firm*—Hinkle & Associates, P.C.

[57] ABSTRACT

A portable, collapsible recreation table for use on unleveled terrain or other area surface suitable for a table to be supported by an implanted stake. This table is comprised of a rimmed table top, three rounded legs which fold up under the table when disassembled, or mount into a connecting disc when assembled, a stake which is implanted into the ground after being threaded into the threaded stake holder in the connecting disc, and the legs are then placed in the leg connectors, also in the connecting disc. The table also has a flexible handle which can be tucked away under the table when the table is in the assembled position. Also included under the table top are a threaded disc holder and stake holders which hold the stake and connection disc when the table is in the disassembled position.

12 Claims, 3 Drawing Sheets

PORTABLE, COLLAPSIBLE, BEACH AND LAWN RECREATION TABLE

BACKGROUND OF THE INVENTION

I. Field of the Invention

The present invention relates generally to the field of portable tables. More particularly, the present invention relates to a portable recreation table supported by a ground engaging stake that is well suited for use on beaches, camp grounds, lawns and the like having uneven terrain.

II. Description of the Related Art

Standard tables are not suitable for use on unlevel surfaces, and are not typically portable for recreational purposes. Therefore, inventors created several types of portable recreation tables. U.S. Pat. No. 4,407,475 issued to Gossage illustrates an earlier attempt at a collapsible, portable recreation table, which is not adjustable for height, does not have a leveling disc, but does have a retractable leg which is complex and a biased latch which after beach or environmental exposure is susceptible to jams and other mechanical problems. Ciulli describes a portable table which anchors into the ground in U.S. Pat. No. 4,852,835. The pointed rigid rod is not collapsible and therefore the disassembled table is not as compact, as well as the protruding rod may be dangerous while transporting. In U.S. Pat. No. 5,417,166 Credle describes a portable umbrella table having many removable pieces which could become lost and are awkward for disassembly, and the umbrella, if kept small enough to keep the table compact, collapsible, and portable could not provide a large amount of value. U.S. Pat. No. 4,920,897 issued to Reed et al. is neither collapsible, height adjustable, portable, nor easily assembled and disassembled. In addition, the parts are not contained within the table, and since the auger is attached to the table, the auger could be dangerous when not engaging the ground. Because there is a hole in the center of the table top to receive the umbrella, the amount of useable table surface is reduced.

SUMMARY OF THE INVENTION

In accordance with the present invention and the contemplated problems which have and continue to exist in this field, one of the objectives of this invention is to provide a portable, collapsible, beach and lawn recreation table that is improved over the prior art.

It is also an object of this invention to provide a level and sturdy table while in unleveled terrain which is accomplished through a spike which is implanted into the ground and is connected to a supporting ring which when placed firmly against the ground minimizes tilting and slanting from wind, heavy objects and the like.

It is another object of this invention to provide a table with non-complex foldable leg mechanisms which allows the table to be easily collapsible and portable.

Still, another object of this invention is to provide a table in a manner in which all parts are contained within the individual unit, whether in the assembled or disassembled mode, and when portable all pieced are contained in a manner which is consistent with safety factors.

Yet, another object of this invention is to provide a table that has an adjustable height.

Still yet, it is another object of this invention to provide a portable table that has increased stability by using three legs.

This invention accomplishes the above and other objectives and overcomes the disadvantages of the prior art by providing a portable, collapsible, beach and lawn recreation table that is simple in design and construction, inexpensive to fabricate, and easy to use. The table has a platform with a rim extending therefrom. Pivotally mounted to the rim are legs which can nest within the rim when the legs are in a closed position. To secure the legs, a connecting disc has slots to receive a second end of the legs. The connecting disc has a threaded bore to receive the threaded end of a ground engaging stake, which allows the table to be used in non-even terrain. Because the table can be easily disassembled, it is well adapted for transport and storage.

It is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Other objects, advantages and capabilities of the invention will become apparent from the following description taken in conjunction with the accompanying drawings showing preferred embodiments of the invention.

BRIEF DESCRIPTION OF THE DRAWINGS

The invention will be better understood and the above objects as well as objects other than those set forth above will become apparent when consideration is given to the following detailed description thereof. Such description makes reference to the annexed drawings wherein.

Figure 2:
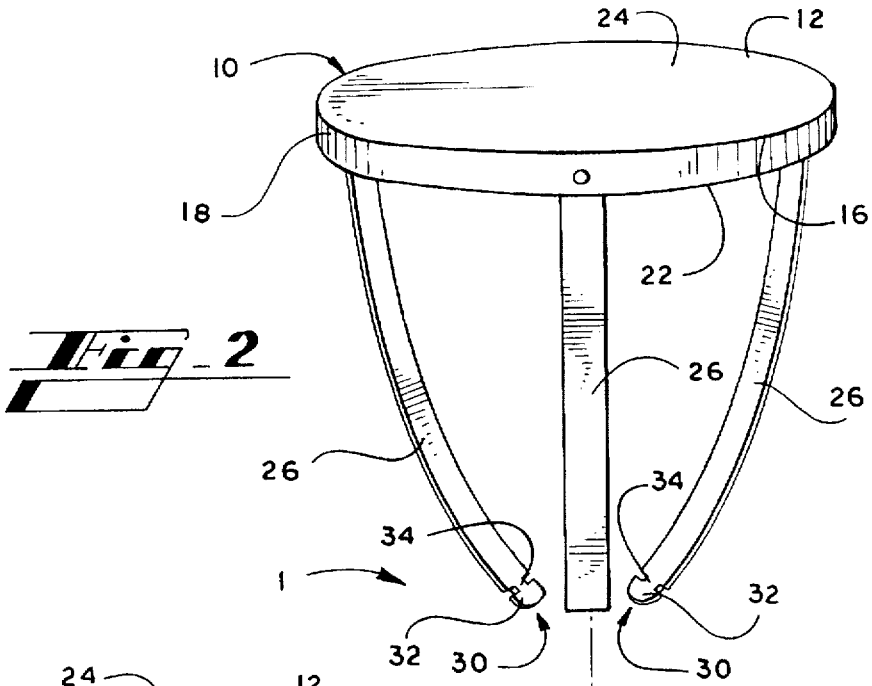
FIG. 2 is an exploded, perspective view of the table of FIG. 1.

The reference numbers in the drawings relate to the following:

1=portable, collapsible, beach and lawn recreation table
10=platform
12=upper surface of platform
14=lower surface of platform
16=outer edge of platform
18=rim of platform
20=inner surface of rim
22=rim edge
24=groove
26=leg
28=first end of leg
30=second end of leg
32=head of leg
34=neck of leg 36=connecting disc
38=circumferential edge of connecting disc
40=mounting wall of connecting disc
44=threaded bore of connecting disc
46=leg connector
48=lower portion of leg connector
50=transverse upper portion
52=stake
54=threaded end of stake
56=pointed end of stake
58=handle
60=threaded disc holder
62=stake holder
64=receiver
66=post
68=stop

DESCRIPTION OF THE PREFERRED EMBODIMENTS

Figure 1:
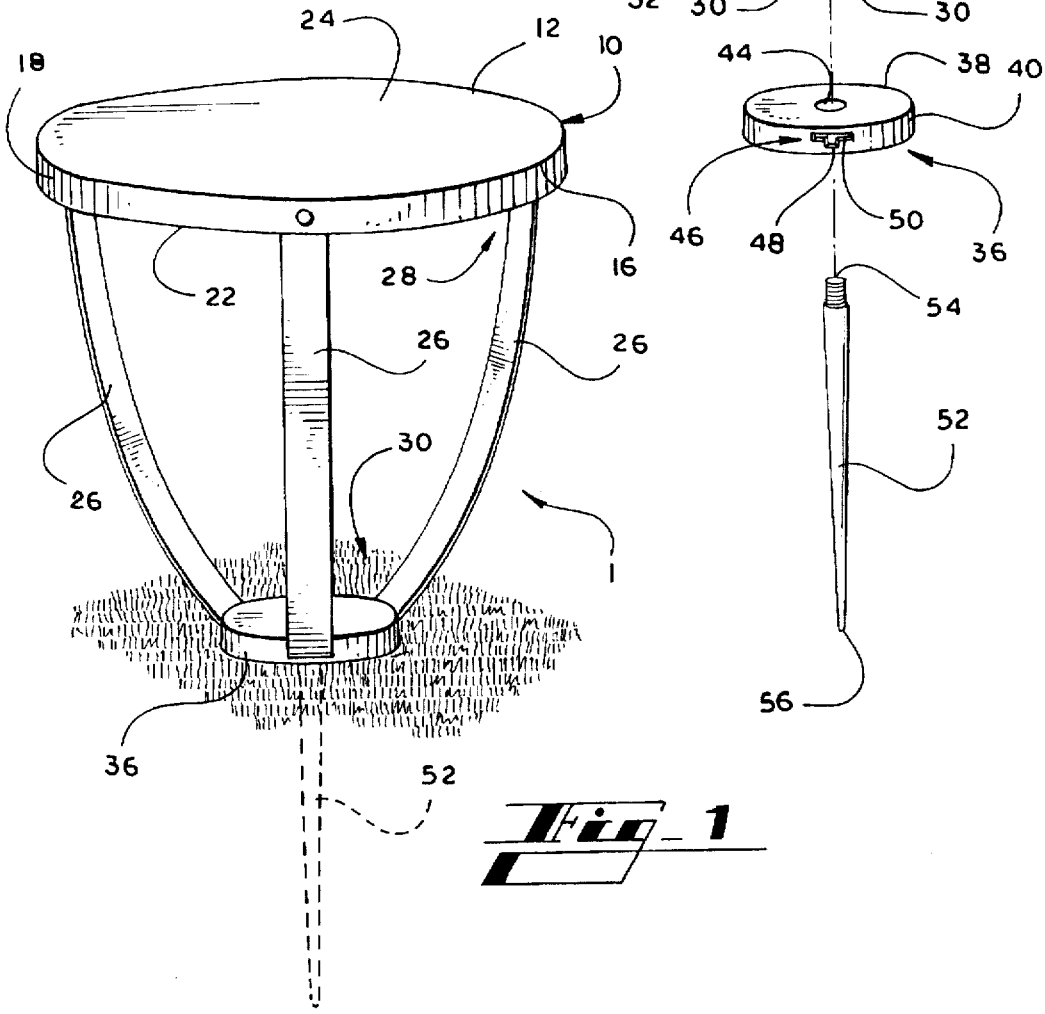
FIG. 1 is a perspective view of a portable, collapsible, beach and lawn recreation table made in accordance with the present invention.

For a fuller understanding of the nature and desired objects of this invention, reference should be made to the following detailed description taken in connection with the accompanying drawings. Referring to the drawings wherein like reference numerals designate corresponding parts throughout the several figures, reference is made first to FIG. 1. FIG. 1 of the drawings illustrates a portable, collapsible, beach and lawn recreation table 1.

Figure 3:
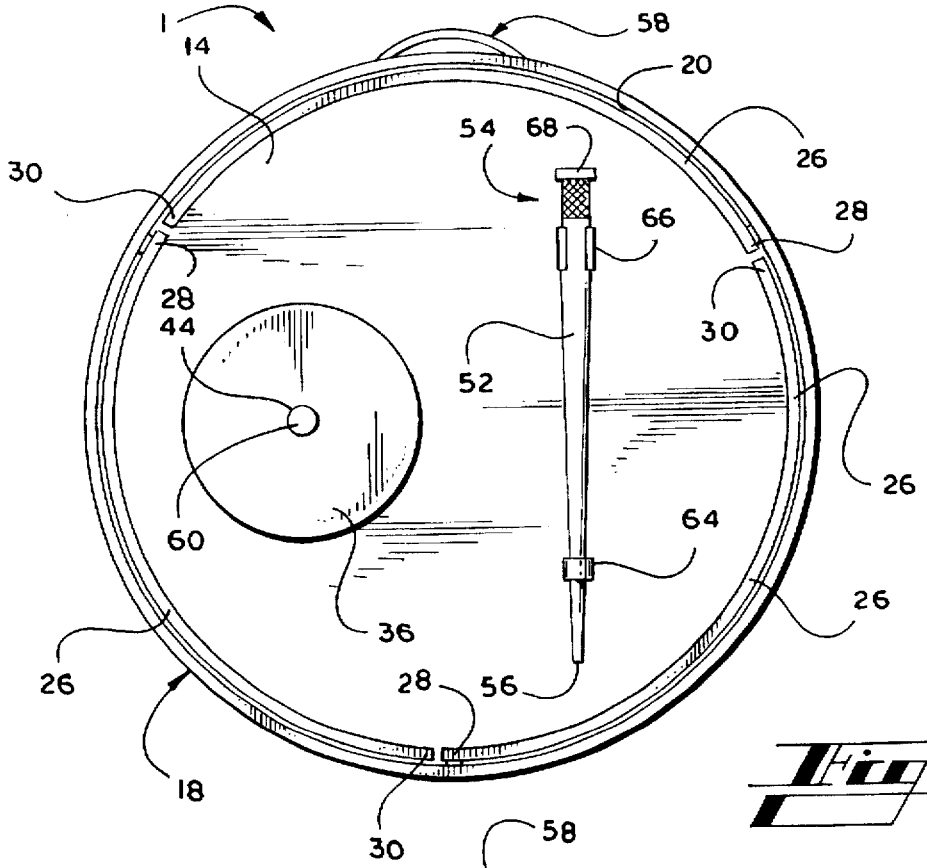
FIG. 3 is a bottom view of the table having various parts thereof shown removably mounted thereto.
Figure 4:
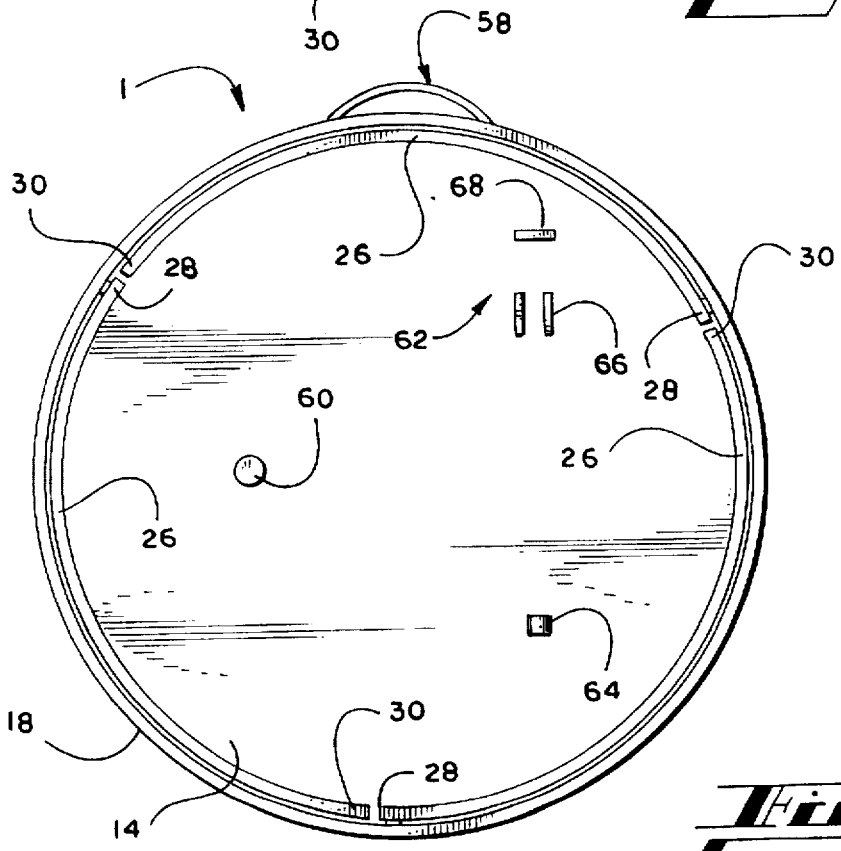
FIG. 4 is a bottom view of the table.
Figure 5:
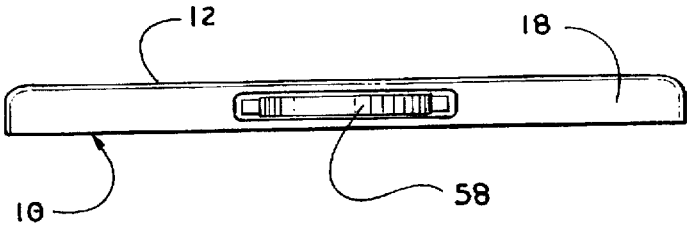
FIG. 5 is a side elevation view of the table showing a handle in a closed position.

Referring to FIGS. 1 through 7, the table 1 has a platform 10 having an upper surface 12, a lower surface 14, an outer edge 16 and a rim 18 extending from the outer edge 16. The rim 18 has an inner surface 20 and a rim edge 22. As shown in FIG. 5, the upper surface 12 is substantially planar. On the upper surface 12 are grooves 24 which form a predetermined pattern.

Figure 6:
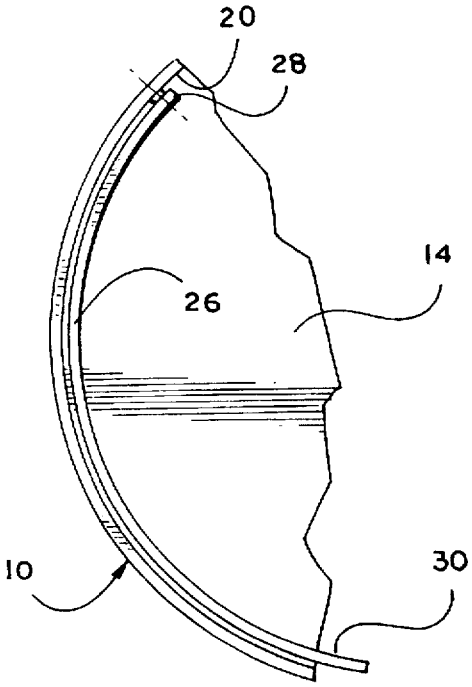
FIG. 6 is a partial bottom view of the table with a leg in a collapsed position.
Figure 7:
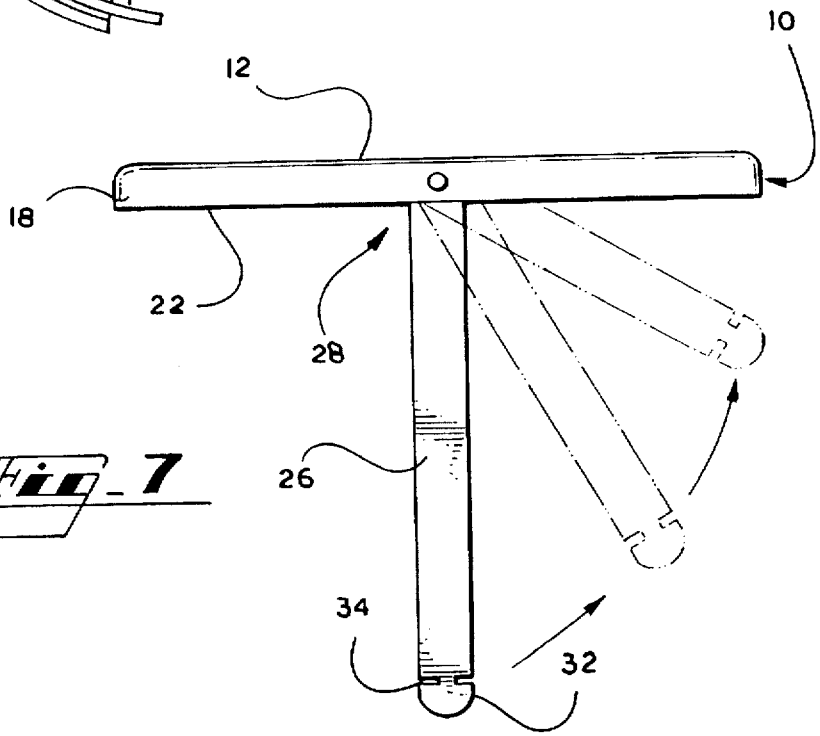
FIG. 7 is a side elevation view of the table and the pivotally mounted leg.

Pivotally mounted to the rim 18 of the platform 10 on the inner surface 20 are a plurality of elongated legs 26. Each leg 26 has a first end 28 and a second end 30. As shown in FIGS. 1, 2 and 7, the legs 26 are pivotally mounted to the rim 18 at the first end 28 are movable to a closed position. A closed position, as shown in FIGS. 4 and 6, is defined as the position of the leg 26 where the second end 30 is placed into contact with the inner surface 20 of the rim 18 between the lower surface 14 of the platform 10 and the rim edge 22. Referring to FIGS. 2 and 7, the second end 30 of the leg 26 is notched to form a head 32 and a neck 34. The neck 34 is discussed further below.

With continuing reference to FIGS. 1 and 2, a connecting disc 36 is removably mounted to the legs 26. The connecting disc 36 has a circumferential edge 38, a mounting wall 40 extending from the circumferential edge 38, a threaded bore 44 and a plurality of leg connectors 46 disposed on the mounting wall 40. Each leg connector is a T-shaped slot having a narrow vertically extending lower portion 48 and a transverse upper portion 50. In operation, the head 32 of the leg 26 extends through the transverse upper portion 50, and the neck 34 removably inserts into and engages the lower portion 48, removably mounting the second end 30 of the leg 26 to the connecting disc 36.

To support the table 1 on a ground surface (not shown), a stake 52 is removably mounted to the connecting disc 36 for removable insertion into the ground surface. The stake 52 has a threaded end 54 and a pointed end 56. The threaded end 54 matingly and removably engages the threaded bore 44 of the connecting disc 36, and the pointed end 56 removably inserts into the ground surface. The height of the platform 10 above the ground surface is adjustable by rotating the connecting disc 36 about the threaded end 54 to adjust the depth of threaded end 54 within the threaded bore 44. The table 1 is removed from the ground by rotating and lifting the table until the stake 52 disengages the ground surface.

As shown in FIGS. 3 and 5, a handle 58 is mounted to the rim 18 of the platform 10. In the preferred embodiment, the handle 58 is capable of being pushed flat against the rim 18 and being extended outwardly from the rim 18 for transport by an operator.

Now referring to FIGS. 3 and 4, the connecting disc 36 and the stake 52 are removably securable to the lower surface 14 of the platform 10 for ease of transport and storage. A threaded disc holder 60 is positioned on the lower surface 14 for removably and matingly engaging the threaded bore 44 of the connecting disc 36. To removably engage and secure the stake 52 to the lower surface 14, a stake holder 62 is provided on the lower surface 14. The stake holder 62 has a receiver 64 with an opening (not shown) for removably receiving the stake 52 proximate the pointed end 56 and a pair of posts 66 to removably engage the stake 52 proximate the threaded end 54. A stop 68 is provided to removably engage the threaded end 54 of the stake 52. FIG. 4 depicts the lower surface 14 of the platform 10 with all legs 26 in the closed position, and also shows the connecting disc 36 and the stake 52 engaging the disc holder 60 and the stake holder 62.

With respect to the above description then, it is to be realized that the optimum dimensional relationships for the parts of the invention, to include variations in size, materials, shape, form, function and manner of operation, assembly, disassembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. A portable recreational table for use on a ground surface, comprising:

a platform having an outer edge and a rim extending from the outer edge;

a plurality of elongated legs being mounted to the platform, each leg having a first end and a second end and being mounted to the rim at the first end;

a connecting disc being removably mounted to the plurality of legs, the connecting disc having a circumferential edge, a mounting wall extending from the circumferential edge, a threaded bore and a plurality of leg connectors disposed on the mounting wall for removably receiving the legs, the leg connectors respectively removably engaging the second ends of the legs; and a stake removably mounted to the connecting disc for engaging the ground surface, the stake having a threaded end and a pointed end, threaded end matingly and removably engaging the threaded bore and the pointed end removably inserted into the ground surface.

2. A portable recreational table as claimed in claim 1, wherein the leg connector is a T-shaped slot having a narrow vertically extending lower portion and a transverse upper portion.

3. A portable recreational table as claimed in claim 2, wherein the second end of the leg is notched to form a head and a neck, the neck removably engaging the lower portion of the slot.

4. A portable recreational table as claimed in claim 1, wherein each leg is pivotally mounted to the rim at the first end.

5. A portable recreational table as claimed in claim 1, wherein the platform has an upper surface and the upper surface is substantially planar.

6. A portable recreational table as claimed in claim 5, wherein the upper surface of the platform has at least one groove.

7. A portable recreational table as claimed in claim 1, wherein the platform has a lower surface and the lower surface has means for receiving and storing the connecting disc and the stake.

8. A portable recreational table as claimed in claim 7, wherein the means for receiving and storing the connecting disc and the stake comprises:

a threaded disc holder for removably and matingly engaging the threaded bore of the connecting disc, and a stake holder for removably engaging the stake, the stake holder having a receiver for removably receiving the stake proximate the pointed end and a pair of posts to removably engage the stake proximate the threaded end.

9. A portable recreational table as claimed in claim 8, wherein the stake holder further comprises a stop to engage the threaded end of the stake.

10. A portable recreational table as claimed in claim 1, further comprising a handle mounted to the rim of the platform.

11. A portable recreational table as claimed in claim 1, wherein each leg at the first end is pivotally mounted to the rim and is pivotally movable to a closed position.

12. A portable recreational table as claimed in claim 1, wherein the platform has a lower surface and the closed position is defined as the position where the second end of the leg contacts the rim proximate the lower surface.

* * * * *